US005747729A

United States Patent [19]

Chassaing et al.

[11] Patent Number: 5,747,729

[45] Date of Patent: May 5, 1998

[54] PROPELLANTS WITH A HIGH SPECIFIC IMPULSE, COMPRISING FURAZANE DERIVATIVES

[75] Inventors: Alain Chassaing, Vert Le Petit; Bernard Finck, Corbeil, both of France

[73] Assignee: Societe Nationale Des Poudres Et Explosifs, Paris Cedex, France

[21] Appl. No.: 863,243

[22] Filed: May 27, 1997

[30] Foreign Application Priority Data

Jun. 28, 1996 [FR] France ..... 96 08051

[51] Int. Cl.[6] ..... C06B 45/10

[52] U.S. Cl. ..... 149/19.1; 149/19.6; 149/92

[58] Field of Search ..... 149/19.1, 19.5, 149/19.6, 92

[56] References Cited

U.S. PATENT DOCUMENTS 5,460,669 10/1995 Willer et al. ..... 149/92

5,529,649 6/1996 Lund et al. ..... 149/19.1

OTHER PUBLICATIONS

Heteroatom Chemistry, vol. 5, No. 5/6, 1994, p. 444 (pp. 441–446).

J. Org. Chem. (1996) –61, pp. 1510–1511.

J. of Heterocycl. Chem. (1968) vol. 5, p. 83 (pp. 83–87).

*Primary Examiner*—Edward A. Miller

*Attorney, Agent, or Firm*—Bucknam and Archer

[57] ABSTRACT

The present invention relates to solid propellants with high specific impulse and/or high impulse per unit volume, more particularly so-called "clean" propellants, that is to say containing no constituents whose combustion gives halogen-containing products or liquid or solid products. The solid propellants according to the invention comprise especially a binder, at least one energetic filler and various additives; the energetic filler is chosen essentially from the group of dinitrated bifurazanes consisting of 3,3'-azoxybis (4-nitrofurazane), 3,3'-azobis(4-nitrofurazane) and 3,3'-bis (4-nitrofurazane).

9 Claims, No Drawings

PROPELLANTS WITH A HIGH SPECIFIC IMPULSE, COMPRISING FURAZANE DERIVATIVES

The present invention relates to the field of solid propellants with high specific impulse and/or high impulse per unit volume. The specific impulse is the thrust developed per unit of weight flow rate of the combustion products. The impulse per unit volume is the product of the specific impulse multiplied by the density of the solid propellant.

The solid propellants involved belong to the classes of composite propellants or of modified double-base propellants; they comprise in particular an inert or energetic binder, at least one energetic filler and optionally conventional additives.

The present invention relates more particularly to such so-called "clean", very unobtrusive solid propellants smokeless or minimum smoke propellants, that is to say those containing no constituents whose combustion gives halogen-containing products or liquid or solid products which give a considerable visible or infrared "signature". Ammonium perchlorate, the combustion of which produces especially gaseous hydrogen chloride, and aluminum, the combustion of which produces alumina, are examples of such constituents.

However, propellants containing such constituents, which will therefore slightly degrade the unobtrusiveness of the propellant, also form part of the invention.

At the present time the so-called "clean" propellants have essentially ammonium nitrate as oxidizing or energetic filler, but the specific impulse remains low; moreover, other problems are linked with the use of ammonium nitrate. Another type of energetic filler, nitramines such as HMX (octogène) or RDX (hexogène) give a higher specific impulse, but aluminum must nevertheless be added to attain high impulses.

The objective of the present invention is to propose solid propellants that are essentially "clean" and have high specific impulses and/or impulses per unit volume.

The present invention relates to solid propellants, with a high specific impulse and/or impulse per unit volume, comprising especially a binder, at least one energetic filler and various additives, characterized in that the energetic filler is chosen essentially from the group of dinitrated bifurazanes consisting of 3,3'-azoxybis(4-nitrofurazane) ($C_4N_8O_7$), 3,3'-azobis(4-nitrofurazane) ($C_4N_8O_6$) and 3,3'-bis(4-nitrofurazane) ($C_4N_6O_6$).

The binder of the solid propellant is of the inert binder or energetic binder type. The essential filler is chosen from the above mentioned group. It may also comprise, for various reasons, other fillers employed elsewhere, such as, for example, nitramines. The various additives referred to here are those conventionally employed by a person skilled in the art, for example for improving chemical stability, combustion kinetics, mechanical properties and the like. These additives represent only a few per cent, by weight, of the propellant.

Advantageously in the case of the solid propellants in which the binder is of the energetic type the energetic filler made of dinitrated bifurazane represents at least 55% by weight of the propellant.

The energetic binders of the present invention are obtained with substituted oxetane or oxirane polymers, nitraminated or nitrated polymers, polyethers and polyesters, these polymers being optionally plasticized with plasticizers which are inert or are themselves energetic, such as especially nitrated oils.

Also advantageously in the case of the solid propellants in which the binder is of the energetic type the energetic filler made of dinitrated bifurazane represents at least 75% by weight of the propellant.

In a particular embodiment of the invention the binder of energetic type is based on polymer with pendent chains with azide ends, such as, for example, a polyglycidyl azide (GAP) or a polybisazidomethyloxetane (BAMO), polyglycidyl azide being the preferred polymer.

Advantageously in the case of the solid propellants in which the binder is of inert type the energetic filler made of dinitrated bifurazane represents at least 70% by weight of the propellant.

The inert binders of the present invention are especially those obtained from optionally grafted, carboxytelechelic or hydroxytelechelic polybutadiene.

Advantageously in the case of the solid propellants according to the invention when the binder is of inert type the energetic filler made of dinitrated bifurazane represents at least 80% by weight of the propellant.

The solid propellants according to the invention optionally also comprise up to 10% by weight of a pulverulent metallic filler such as aluminum, to increase its specific impulse further and furthermore to suppress possible instabilities in combustion. However, a metallic filler introduced in such a proportion degrades the unobtrusiveness of the propellant.

The synthesis of the dinitrated bifurazanes employed in the present invention is described in the literature:

in the case of 3,3'-azoxybis(4-nitrofurazane) ($C_4N_8O_7$), in Heteroatom Chemistry, vol. 5, No. 5/6, page 444 (1994).

The structural formula of this compound is:

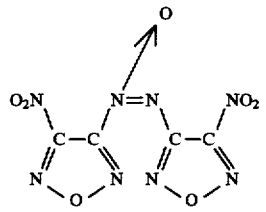

in the case of 3,3'-azobis(4-nitrofurazane) ($C_4N_8O_6$), in Journal of Organic Chemistry, vol. 61, pages 1510 to 1511 (1996), The structural formula of this compound is:

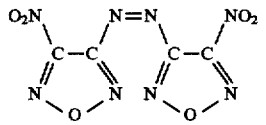

in the case of 3,3'-bis(4-nitrofurazane) ($C_4N_6O_6$) in J. of Heterocyclic Chemistry, vol. 5, page 83 (1968).

The structural formula of this compound is:

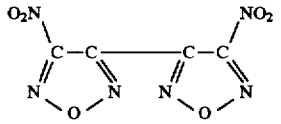

The propellants are produced in accordance with the techniques which are usual in the class to which they belong; essentially casting-blending or extrusion blending techniques.

The examples which follow give the performance: specific impulse and impulse per unit volume for various propellants according to the invention. The specific impulse is determined in standard conditions: expansion to equilibrium and 70/1 expansion ratio. The specific impulse is denoted by Is and is expressed in seconds. The impulse per unit volume is the product of the specific impulse multiplied by the propellant density: it is denoted by ρ Is and is expressed in s g $cm^{-3}$.

EXAMPLE 1

This example relates to propellants in which the binder, of energetic type, is based on polyglycidyl azide (GAP), 24% by weight, crosslinked with 6% of hexamethylene diisocyanate trimer, the binder is highly plasticized, 66%, with a mixture of trimethylolethane trinitrate and butanetriol trinitrate in proportions of 70/30, the remainder comprising various additives (anti-oxidants etc). The energetic filler is 3,3'-azoxybis(4-nitrofurazane); in the case of the reference propellant the energetic filler is HMX.

Table 1 gives the results.

TABLE 1

| Binder | | Energetic filler | | Is (s) | ρ Is s g $cm^{-3}$ |
|---|---|---|---|---|---|
| 15% | GAP | 85% HMX | | 261 | 475 |
| 45% | GAP | 55% | 3,3'-azoxybis-(4-nitrofurazane) | 265 | 440 |
| 30% | GAP | 70% | 3,3'-azoxybis-(4-nitrofurazane) | 275 | 475 |
| 15% | GAP | 85% | 3,3'-azoxybis-(4-nitrofurazane) | 280 | 510 |
| 10% | GAP | 90% | 3,3'-azoxybis-(4-nitrofurazane) | 280 | 515 |

At a filler content which is equal to or higher than that of the reference propellant, the propellant according to the invention has a specific impulse and an impulse per unit volume which is higher. The energetic filler content can be decreased to approximately 55% while still retaining a higher specific impulse; on the other hand, the impulse per unit volume tends to decrease. The energetic filler content can be 15% lower than that in the reference propellant while having a specific impulse and an impulse per unit volume which is at least equal.

EXAMPLE 2

This example again relates to propellants with a binder of energetic type; the binder, called G, is produced from a polyester: 20% by weight of diethylene glycol polyadipate crosslinked with 4% of hexamethylene diisocyanate trimer, plasticized with 71% of a mixture of nitroglycerine and of butanetriol trinitrate in proportions of 80/20, the remainder including various feasibility and stability additives. These propellants, except for one, additionally comprise a small quantity of various additives. The reference propellant is filled with HMX and additives. Table 2 gives the results, (A) corresponding to the name (4-nitrofurazane).

TABLE 2

| Binder | Energetic filler | Additives (1) | Is (s) | ρ Is s g $cm^{-3}$ |
|---|---|---|---|---|
| 30% G | 65% HMX | 5% | 249 | 441 |
| 30% G | 70% 3,3'-azoxybis (A) | 0% | 275 | 475 |
| 30% G | 65% 3,3'-azoxybis (A) | 5% | 268 | 476 |
| 30% G | 65% 3,3'azobis (A) | 5% | 264 | 441 |
| 30% G | 65% 3,3'-bis (A) | 5% | 268 | 476 |

(1) The 5% of additives include: 1% of aluminium (anti-instability), 3% of lead citrate and 1% of acetylene black (combustion modifiers).

The specific impulses and the impulses per unit volume of the propellants according to the invention are clearly superior to those of the reference propellant.

EXAMPLE 3

This example relates to composite propellants with an inert binder; this is a binder based on 70% by weight of hydroxytelechelic polybutadiene (HTPB, type R45M) crosslinked with 6.5% of methylenecyclohexyl diisocyanate, the whole plasticized with 23% of dioctyl azelate. The reference propellant has a filling of 85% of HMX. Table 3 gives the results obtained.

TABLE 3

| Binder | Energetic filler | Is (s) | ρ Is s g $cm^{-3}$ |
|---|---|---|---|
| 15% HTPB | 85% HMX | 230 | 380 |
| 30% HTPB | 70% 3,3'-azoxybis(4-nitrofurazane) | 234 | 340 |
| 20% HTPB | 80% 3,3'-azoxybis(4-nitrofurazane) | 250 | 390 |

TABLE 3-continued

| Binder | Energetic filler | Is (s) | ρ Is s g $cm^{-3}$ |
|---|---|---|---|
| 15% HTPB | 85% 3,3'-azoxybis(4-nitrofurazane) | 260 | 430 |
| 15% HTPB | 85% 3,3'-azobis(4-nitrofurazane) | 254 | 387 |
| 15% HTPB | 85% 3,3'-bis(4-nitrofurazane) | 259 | 426 |
| 10% HTPB | 90% 3,3'-azoxybis(4-nitrofurazane) | 274 | 470 |

At the same filler content, the various dinitrated bifurazanes give propellants whose specific impulse is considerably higher, by 20 to 30 s, than that of the reference propellant. The same applies to the impulse per unit volume. The energetic filler content can be reduced to approximately 75% while retaining the high specific impulses and comparable impulses per unit volume.

EXAMPLE 4

The examples below relate to aluminized propellants in which the binder is of the energetic type, based on a polyglycidyl azide (GAP), identical with that of Example 1; the energetic filler of the reference propellant is HMX. Table 4 gives the results obtained, (A) corresponding to the name (4-nitrofurazane).

TABLE 4

| GAP binder % | Energetic filler | aluminium (%) | Is (s) | ρ Is s g $cm^{-3}$ |
|---|---|---|---|---|
| 25% GAP | 65% HMX | 10% | 270 | 485 |
| 25% GAP | 65% 3,3'-azoxybis (A) | 10% | 281 | 505 |
| 25% GAP | 70% 3,3'-azoxybis (A) | 5% | 280 | 500 |
| 15% GAP | 80% 3,3'-azoxybis (A) | 5% | 282 | 515 |
| 20% GAP | 70% 3,3'-azoxybis (A) | 10% | 282 | 512 |
| 15% GAP | 75% 3,3'-azoxybis (A) | 10% | 282 | 525 |

The addition of aluminum to the propellants according to the invention (see also Table 1), at the expense of the energetic filler, improves or at least maintains the performance, in particular the impulse per unit volume. These performances are clearly superior to those of propellant with the same aluminum filler content but in which the energetic filler is HMX. Although it degrades the unobtrusiveness of the propellant, the addition of aluminum may be necessary, for example, to eliminate possible instabilities in combustion.

We claim:

1. Solid propellant with high specific impulse, comprising especially a binder, at least one energetic filler and various additives, characterized in that the energetic filler is chosen essentially from the group of dinitrated bifurazanes consisting of 3,3'azoxybis(4-nitrofurazane) ($C_4N_8O_7$), 3,3'-azobis (4-nitrofurazane) ($C_4N_8O_6$) and 3,3'-bis(4-nitrofurazane) ($C_4N_6O_6$).

2. Solid propellant according to claim 1, characterized in that the binder is an energetic binder and that the energetic filler made of dinitrated bifurazane represents at least 55% by weight of the propellant.

3. Solid propellant according to claim 2, characterized in that the energetic filler made of dinitrate bifurazane represents at least 75% by weight of the propellant.

4. Solid propellant according to claim 2, characterized in that the energetic binder is based on a polyether or a polyester plasticized with at least one nitrated oil.

5. Solid propellant according to claim 2, characterized in that the energetic binder is based on a polymer with pendent chains with azide ends.

6. Solid propellant according to claim 2, characterized in that it also comprises up to 10% by weight of a pulverulent metallic filler.

7. Solid propellant according to claim 1, characterized in that the binder is an inert binder and that the energetic filler made of dinitrated bifurazane represents at least 70% by weight of the propellant.

8. Solid propellant according to claim 7 characterized in that the energetic filler made of dinitrated bifurazane represents at least 80% by weight of the propellant.

9. Solid propellant according to claim 7, characterized in that it also comprises up to 10% by weight of a pulverulent metallic filler.

* * * * *